US005218150A

United States Patent [19]

Pastor

[11] Patent Number: 5,218,150

[45] Date of Patent: Jun. 8, 1993

[54] BRASS INSTRUMENT MOUTHPIECE

[76] Inventor: Herman Pastor, 79 Shady Nook Dr., Toms River, N.J. 08753

[21] Appl. No.: 637,800

[22] Filed: Jan. 7, 1991

[51] Int. Cl.[5] ..... G10D 9/02
[52] U.S. Cl. ..... 84/398; 84/399
[58] Field of Search ..... 84/398, 399

[56] References Cited

U.S. PATENT DOCUMENTS

| | | | |
|---|---|---|---|
| 566,435 | 8/1896 | Witmer | 84/399 |
| 795,480 | 7/1905 | Carson | 84/399 |
| 1,691,669 | 11/1928 | Ostendorf | 84/399 |
| 2,758,497 | 8/1956 | Sarad | 84/399 |

FOREIGN PATENT DOCUMENTS

| | | | |
|---|---|---|---|
| 2476 | 6/1881 | United Kingdom | 84/399 |

*Primary Examiner*—Michael L. Gellner
*Assistant Examiner*—Eddie C. Lee
*Attorney, Agent, or Firm*—Charles I. Brodsky

[57] ABSTRACT

A brass instrument mouthpiece is described as incorporating an adjustable cup depth to enhance performance in the upper register of the instrument, without sacrificing tonal quality in the lower register. In accordance with a preferred embodiment of the invention, an interchangeable mouthpiece rim and sleeve are correspondingly threaded to flushingly fit together, and to receive a threaded mouthpiece shank and cup to an adjustable depth. A threaded lock is secured to the shank when the cup is located at the depth desired with respect to the rim, to then set the mouthpiece ready for use.

8 Claims, 2 Drawing Sheets

BRASS INSTRUMENT MOUTHPIECE

FIELD OF THE INVENTION

This invention relates to brass instrument mouthpieces and, more particularly, to a mouthpiece having an adjustable cup depth to enhance performance in the upper register of the instrument, without sacrificing tonal quality in the lower register.

BACKGROUND OF THE INVENTION

As is well known and understood buyers of brass instrument mouthpieces generally make their selection based on the rim size of the mouthpiece and upon the width and depth of its cup. These selections are usually made by the instrumentalist based on his, or her, embouchure development, the tonal range desired and the perceived brilliance of the notes produced. With this in mind, it is not hard to understand why many players of trumpets and/or trombones possess up to 15, 20, 25 and even more mouthpieces as their preferences of play change over time, and to suit their beliefs as to what any given mouthpiece will do for them at any particular instance. Not only are such multiple purchases over time quite costly, and not only do they present a measurable difficulty in storage and in the identification of what each one does different from another, but they present to the instrumentalist so many combinations for selection that the player really does not appreciate which mouthpiece to use, when to use it, and exactly why it is being used to begin with.

SUMMARY OF THE INVENTION

As will become clear hereinafter, with the brass instrument mouthpiece of the invention, on the other hand, a manner of adjusting the cup depth is afforded, and to the extent that the instrumentalist can readily select the depth desired to meet his, or her, preferences as to tonal quality, and to allow the instrumentalist to perform in the upper register of the instrument without spending years of embouchured development in strengthening the lip muscles. As will be seen, by simply adjusting the cup depth to a shallower position, performance can be had in the higher register, without sacrificing tonal qualities in the lower register of the instrument, all the while maintaining the throat and back-bore substantially the same so as to maintain resistance constant, regardless of the register which is being played.

As will be seen, the brass instrument mouthpiece of the invention, in a preferred embodiment, incorporates an interchangeable mouthpiece rim and sleeve which are correspondingly threaded to flushingly fit together, and receive a threaded mouthpiece lock is also incorporated, to secure to the shank when the cup is located at the depth selected with respect to the rim, to then hold the mouthpiece set, ready for use. With the interchangeability of rims for comfort and with the availability of different shanks for different cup diameters, the backbore can then be selected fairly large, so as to permit a preferred brilliance in tone at any cup setting, be it shallow or deep. As will be apparent, the end result can then be a single mouthpiece, with a rim that the player is used to, a shank that they are comfortable with, a cup whose width they are familiar with, and a simple manner of adjusting the cup depth to meet their individual preferences at any instant of playing.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE DRAWINGS

Figure 1:
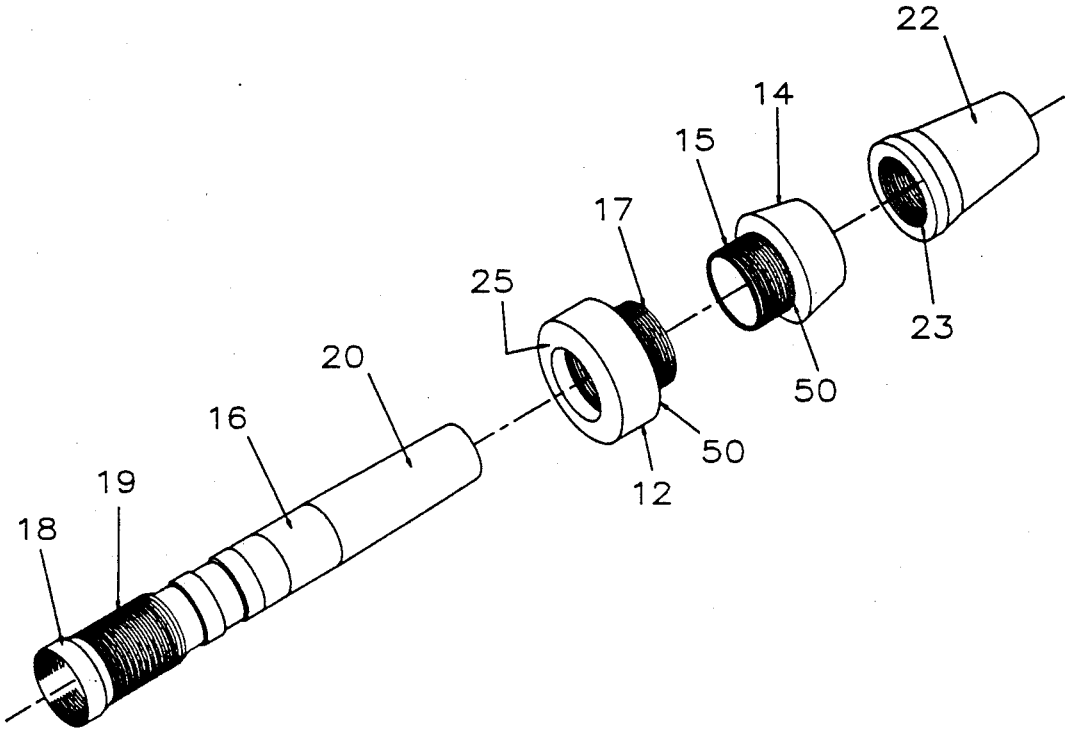
FIG. 1 illustrates the 4 interchangeable components of the mouthpiece of the invention as they would appear in dis-assembled form.
Figure 2:
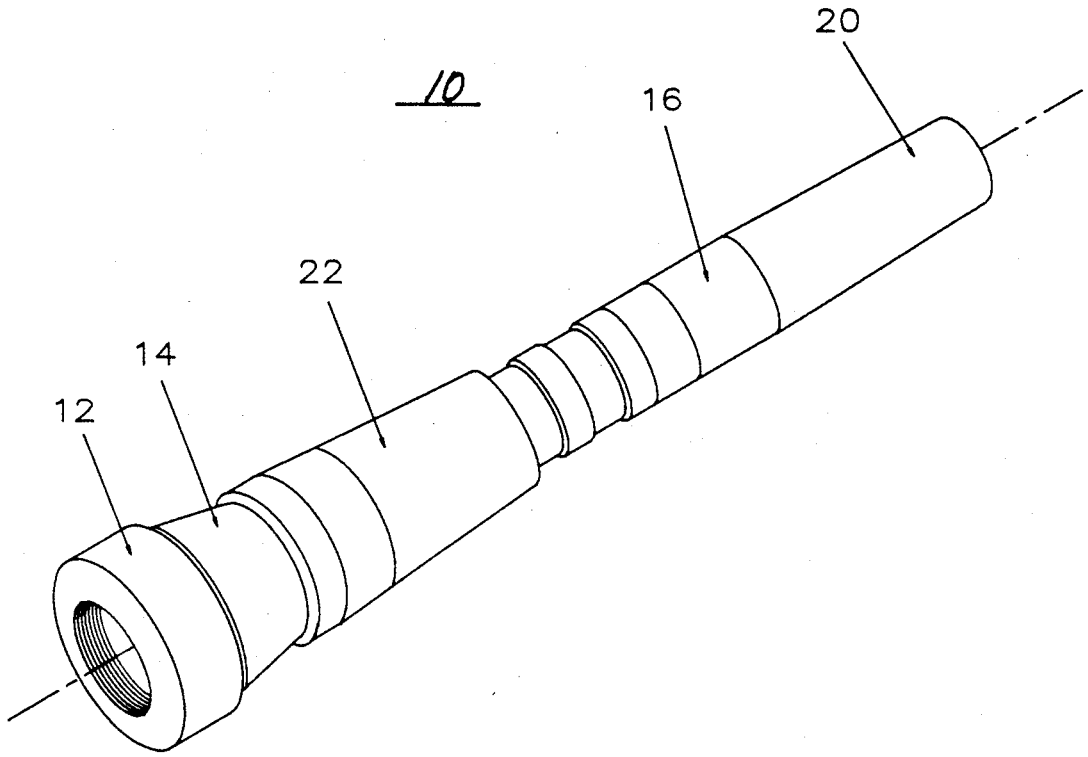
FIG. 2 shows the mouthpiece of the invention (albeit of different scale) with the interchangeable parts assembled together for a given, desired cup depth, ready for use.

Referring to the drawings, reference numeral 10 illustrates the mouthpiece of the invention as it would appear assembled, ready for use by the instrumentalist. An interchangeable rim 12 of differing dimensional size is depicted, along with a correspondingly threaded sleeve 14 to flushingly fit together, with the outside threads 15 of the sleeve 14 mating with the inside threads 17 of the rim 12. As will be seen, the rim 12, to accomplish this, is threaded internally, whereas the sleeve is provided with an external thread so that the two components 12, 14 effectively screw together.

A mouthpiece shank 16 is also illustrated, having a cup 18 at a first end, an external threading 19 which is adjacent to it, and an opposite end 20. The fourth component of the mouthpiece, a lock, is represented in the drawings by the reference numeral 22, and is shown as being internally threaded at 23 such that when the mouthpiece shank 16 is inserted through the rim 12 and the sleeve 14, the internal threads 23 of the lock 22 correspondingly mate with, and screw with, the external threads 19 of the mouthpiece shank 16.

In assembling the mouthpiece, the sleeve 14 is first screwed into the rim 12 to obtain a flush fit. The mouthpiece shank 16 is closely machined so that when its end 20 is inserted through the rim 12 and sleeve 14, where, because of its close-tolerance machining, the cup rides up and down, towards and away from the rim surface 25. Once the cup depth is established, the lock 22—into which the shank 16 is also inserted—is secured fast in position by the mating of the threads 19 and 23, to hold the rim in place with respect to the cup setting and so that the mouthpiece is then ready for use. In a preferred embodiment of the invention, unloosening of the lock 22 followed by a clockwise rotation of the mouthpiece shank 16 causes a winding-up of the shank 16 to make the cup shallower so as to ease the playing of the extreme upper register notes. The lock 22, of course, is first secured before the playing is to take place. When it is thereafter desired to obtain a fullness of sound, the lock 22 is released, the shank 16 is rotated counterclockwise, and the cup 18 thereby winds down, followed by the securing of the lock once again. Although not shown as such, it will be readily appreciated by those skilled in the art that various "micrometer-type" setting notations can be inscribed along the mouthpiece shank 16 and lock 22 where the shank exists the lock for ease of alignment in selecting a given cup depth at any instance of time. At the same time, rims 12 of different diameter can be made available, as can the shank with different cup diameters so as to provide a range of adjustments to the instrument list beyond the wide range of adjustments available in cup depth by mere rotation of the mouthpiece shank 16 and lock 22. In these respects, it will be seen that the rim 12 and sleeve 14 are each provided with facing shoulder surfaces 50 which then bear against one another once the rim 12 and sleeve 14 are threaded together—with this requirement and the close tolerance of the cup and various threadings being required so as to substantially eliminate any air leakage through the mouthpiece during play. Once the desired rim size is selected and the four component parts 12, 14, 16 and 22 threaded together, all that becomes necessary is for the winding of the shank piece 16 along with its cup 18 to the desired depth, and the securement in place by the lock 22 so as to enable the player to perform at the desired tonal register without having to try each of several individual mouthpieces, until the one is found which best approximates what the instrumentalist then desires. In such manner, the brass instrument mouthpiece of the invention is able to take on the appearance and performance of many separate different mouthpieces all in a single unit, and enable numerous degrees of different settings with any combination based upon the rim size employed and the shank with cup width decided upon.

While there has been described what is considered to be a preferred embodiment of the present invention, it will readily be appreciated by those skilled in the art that modifications can be made without departing from the scope of the teachings herein. For at least such reason, therefore, resort should be had to the claims appended hereto for a true understanding of the scope of the invention.

I claim:

1. A brass instrument mouthpiece consisting:

an internally threaded rim;

an externally threaded sleeve to thread together with said rim and flushingly fit together therewith;

a mouthpiece shank having a cup at a first end, an external threading adjacent thereto, and a second opposite end;

an internally threaded lock;

with the opposite end of said mouthpiece shank inserted through said rim, said sleeve and into said lock a predetermined, adjustable distance;

and with the external threading on said shank threading with the internal threading on said lock to secure the threading of said lock with the threading on said shank and the fixing of said cup at a preselected distance from said rim.

2. The mouthpiece of claim 1 wherein said rim is of an interchangeable set of different sizes.

3. The mouthpiece of claim 1 wherein said rim and said sleeve are each provided with facing shoulder surfaces which bear against one another when said rim and sleeve are threaded together.

4. The mouthpiece of claim 1 wherein the cup of said mouthpiece shank is of a diameter to flushingly fit with the internal threading of said rim when the opposite end of said shank is inserted through said sleeve and into said lock.

5. A brass instrument mouthpiece consisting;

a rim having an external diameter $D_1$ and a threaded internal diameter $D_2$;

a sleeve having a threaded first surface of external diameter $D_3$ and having a second surface of external diameter $D_4$;

a lock having a threaded internal diameter $D_5$ and an external diameter $D_6$;

a mouthpiece shank having a cup at a first end of diameter $D_7$, an external threading of diameter $D_8$ adjacent thereto, and a second opposite end of diameter $D_9$;

with the diameter $D_3$ being just slightly different from the diameter $D_2$ for threading said rim and said sleeve together, with the diameter $D_7$ being just slightly smaller than the diameter $D_2$ for flushingly fitting said cup within said rim, with the diameter $D_9$ being less than the diameter $D_2$, $D_3$ and $D_5$ for inserting the second end of said shank through said rim, said sleeve and said lock a predetermined, adjustable distance, and with the diameter $D_8$ being less than the diameters $D_2$ and $D_3$ and just slightly different from the diameter $D_5$ for securing the threading of said lock with the threading on said mouthpiece shank and the fixing of said cup at a preselected distance from said rim.

6. The mouthpiece of claim 5 wherein the diameter $D_1$ is one of interchangeably different size.

7. The mouthpiece of claim 5 wherein the diameter $D_4$ is less than the diameter $D_1$.

8. The mouthpiece of claim 6 wherein the diameter $D_6$ is substantially equal to the diameter $D_4$.

* * * * *